US005864727A

United States Patent [19]

Omori et al.

[11] Patent Number: 5,864,727

[45] Date of Patent: Jan. 26, 1999

[54] RACK FOR FEEDING PHOTOSENSITIVE MATERIAL

[75] Inventors: Hisashi Omori; Tomoya Tanaka, both of Wakayama, Japan

[73] Assignee: Noritsu Koki Co., Ltd., Wakayama, Japan

[21] Appl. No.: 901,072

[22] Filed: Jul. 28, 1997

[30] Foreign Application Priority Data

Jul. 29, 1996 [JP] Japan ..... 8-198968
Jul. 31, 1996 [JP] Japan ..... 8-202197

[51] Int. Cl.[6] ..... G03D 3/02; G03D 3/08

[52] U.S. Cl. ..... 396/612; 396/617; 396/620; 396/626; 396/627

[58] Field of Search ..... 396/564, 612, 396/617, 620, 626, 627, 636

[56] References Cited

FOREIGN PATENT DOCUMENTS 0 611 994 8/1994 European Pat. Off. .
0 703 496 9/1994 European Pat. Off. .
0 695 970 2/1996 European Pat. Off. .
35 36 863 4/1987 Germany .

*Primary Examiner*—D. Rutledge
*Attorney, Agent, or Firm*—Wenderoth, Lind & Ponack, L.L.P.

[57] ABSTRACT

A rack which can completely expel air remaining in treating solution passages. The rack has a rack body formed with a downward feed path and an upward feed path. A rack plate is provided on the outer side of each feed path. Each plate has treating solution passages extending in a width direction of the plate, and nozzles for blowing treating solution fed into the treating solution passages into the feed paths. An air reservoir is formed in the longitudinal central portion of each treating solution passage. An air vent passage is connected to the top of each air reservoir. If there is any air remaining in the treating solution passages when the rack body is set, such air can be urged into the air reservoirs by treating solution flowing into the treating solution passages and expelled from the air vent passages.

2 Claims, 5 Drawing Sheets

RACK FOR FEEDING PHOTOSENSITIVE MATERIAL

BACKGROUND OF THE INVENTION

This invention relates to a rack for feeding photosensitive material to be developed in an automatic developing device.

An automatic developing device has a plurality of tanks arranged in one direction and filled with developing, bleaching, fixing, stabilizing and other solutions. Photosensitive material is developed by being immersed in these tanks one after another. A rack is mounted in each tank and photosensitive material is fed through the rack.

Such a rack has a guide path for guiding photosensitive material, and a feed device for feeding photosensitive material through the guide path.

To save natural resourses and protect the environment, the amount of treating solution used in an automatic developing device should be limited to a minimum. For this purpose, there has been proposed a hollow rack having a body formed with a slit-shaped feed path, and rack plates provided on both sides of the rack body to define the feed paths. The rack plates are formed with a plurality of treating solution passages elongated in a width direction of the plates and arranged in a vertical direction. A slit-shaped nozzle is connected to each treating solution passage. Treating solution is blown from the nozzles against the photosensitive material which is being fed through the feed path.

When this slit type rack is immersed in the treating solution of each tank, air is inevitably trapped and remains in the treating solution passages. Such air is mostly expelled from the passages together with treating solution flowing through the passages. But it is difficult to completely expel air in the passages. Any remaining air tends to disturb the flow of treating solution discharged from the slit, making difficult uniform spraying of developing solution on photosensitive material. Thus, photosensitive material is developed partially quickly and partially slowly, so that the quality of the developed material tends to be unstable.

Also, by contact with the remaining air, treating solution tends to deteriorate.

In such an automatic developing machine, treating solution is circulated between the treating solution tank and a sub-tank communicating with the top of the treating solution tank to keep the solution temperature uniform. A heater is provided in the sub-tank to keep the solution temperature at a predetermined level.

A conventional slit type rack has its feed paths open at the bottom of the rack body. Treating solution in the rack body is discharged through the bottom openings into the treating solution tank. Thus, treating solution in the rack body cannot flow smoothly into a gap between the treating solution tank and the rack body. Due to poor circulation of treating solution in the rack body, it was difficult to uniformly develop photosensitive material with stable quality.

An object of this invention is to provide a slit type rack which can completely expel air remaining in the treating solution passages, thereby stabilizing the quality of developed material.

Another object of this invention is to provide a slit type rack which can smoothly circulate treating solution in the rack body, thereby improving the quality of developed material.

SUMMARY OF THE INVENTION

According to this invention, there is provided a rack for feeding photosensitive material comprising a rack body, a pair of rack plates provided at both sides of the rack body, the rack body being formed with a pair of feed paths extending vertically along opposed inner surfaces of said rack plates and having a slit-shaped section, and a turn unit provided at the bottom end of the rack body for guiding photosensitive material fed through one of the feed paths into the other of the feed paths by changing the feed direction of the photosensitive material, each of the rack plates being formed with treating solution passages extending in the width direction of the each rack plate, and nozzles for blowing treating solution fed under pressure into the treating solution passages from outer ends thereof, each of the treating solution passages being provided with an air reservoir having its top connected to an air vent passage.

According to this invention, each of the rack plates is formed with a plurality of treating solution return holes extending through each rack plate from its inner surface to outer surface.

At least one air reservoir is formed in each treating solution passage. If one air reservoir is provided, it is preferably provided in the longitudinal center of each passage.

Other features and objects of the present invention will become apparent from the following description made with reference to the accompanying drawings, in which:

DETAILED DESCRIPTION OF THE PREFERRED EMBODIMENT

Figure 1:
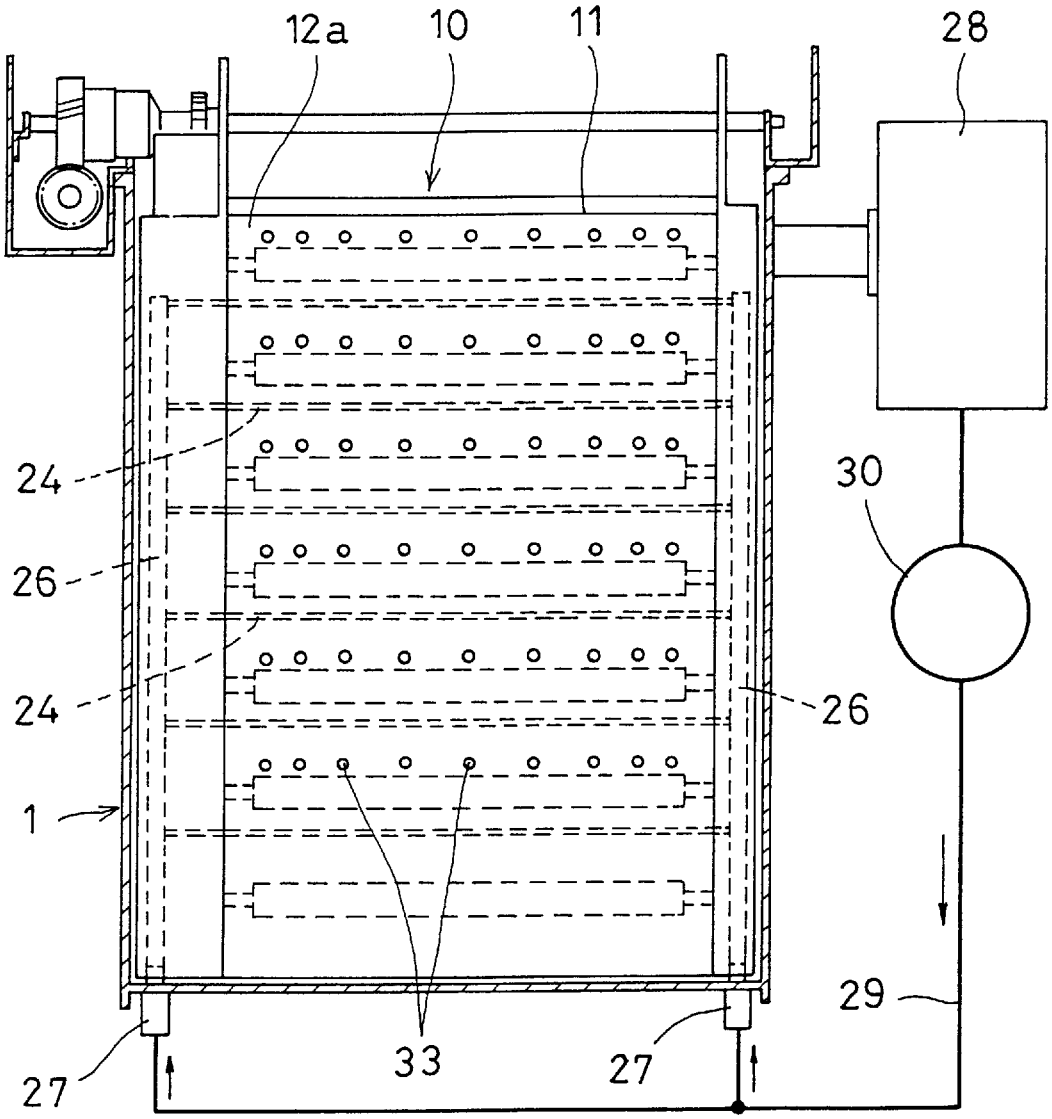
FIG. 1 is a vertical sectional front view of an embodiment according to this invention.
Figure 2:
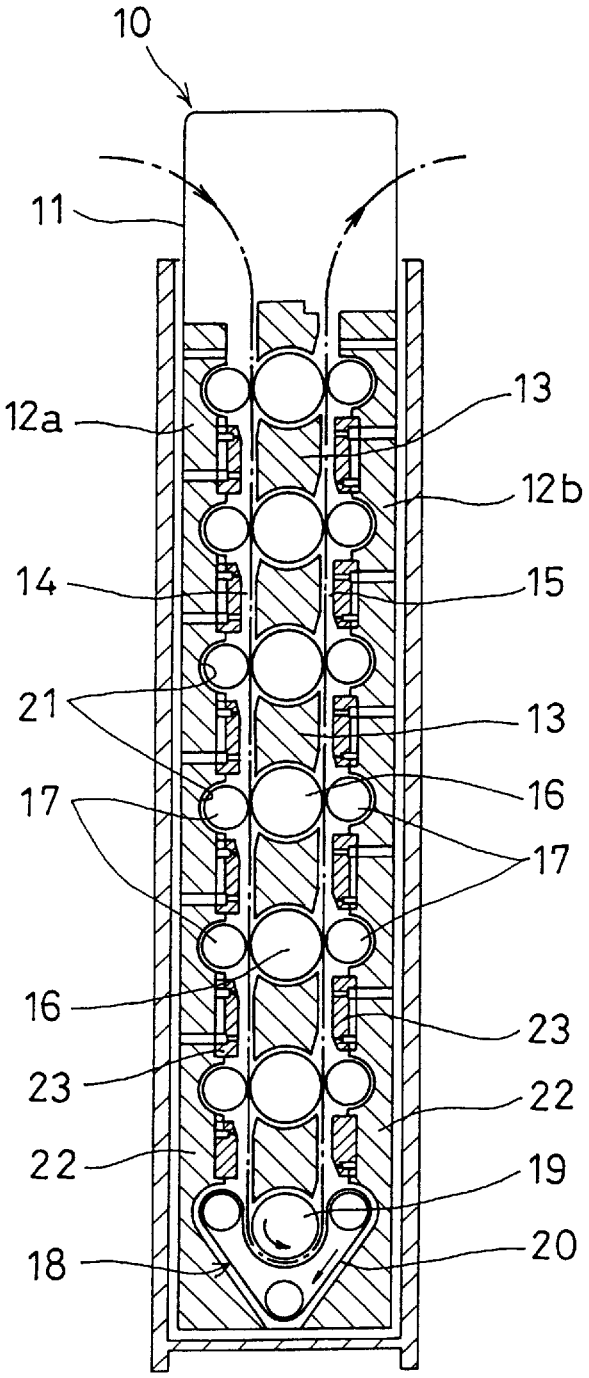
FIG. 2 is a vertical sectional side view thereof.

Embodiments of this invention are now described with reference to the drawings. FIGS. 1 and 2 show a treating solution tank 1 in which is mounted a slit type rack 10 according to this invention.

The rack 10 has a rack body 11 comprising front and rear rack plates 12*a*, 12*b*, and a plurality of intermediate guide blocks 13 arranged vertically between the rack plates 12*a* and 12*b*. A downward feed path 14 having a slit-shaped section is defined between the intermediate guide blocks 13 and the front rack plate 12*a*. An upward feed path 15 having a slit-shaped section is defined between the intermediate guide blocks 13 and the rear rack plate 12*b*.

Feed rollers 16 are provided between the adjacent ones of the vertically arranged intermediate guide blocks 13. A pair of pressure rollers 17 are pressed against each feed roller 16 from both sides.

Figure 3:
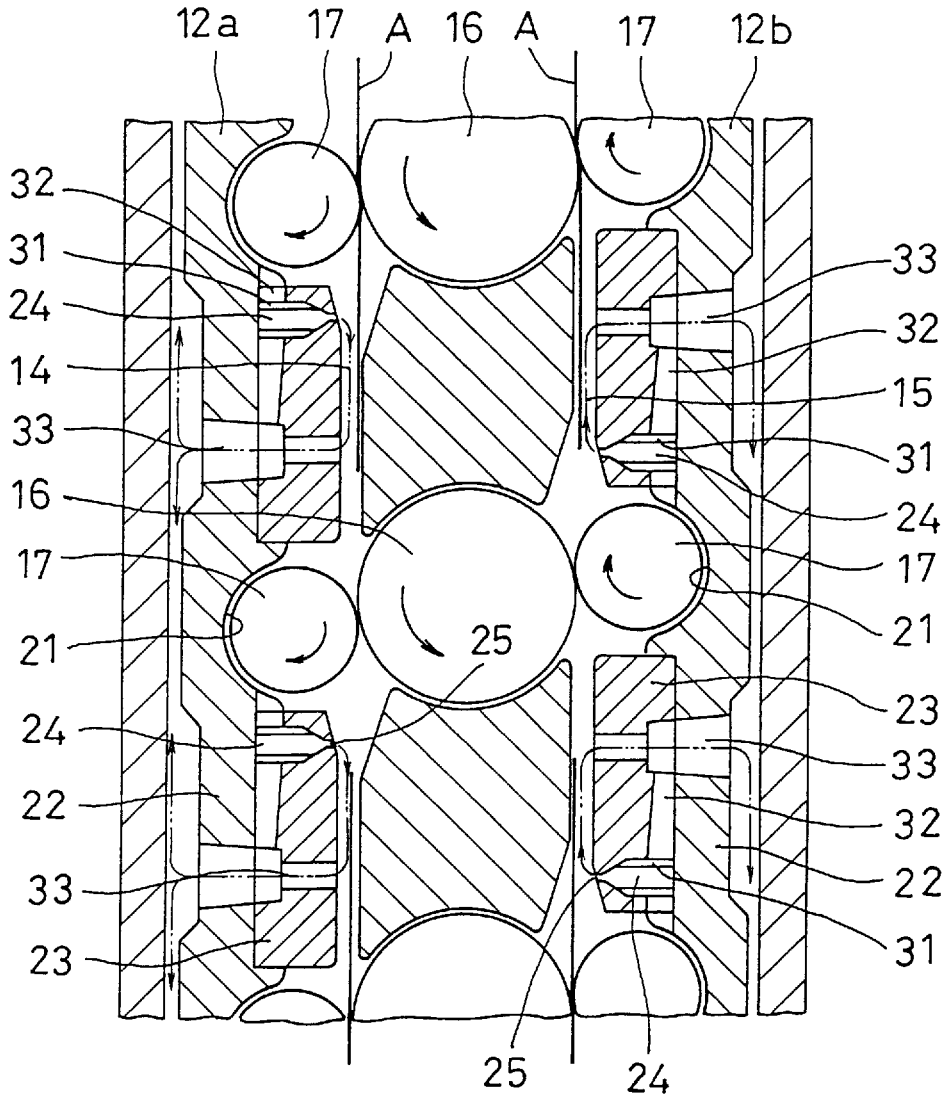
FIG. 3 is a partial enlarged sectional view of FIG. 2.
Figure 4:
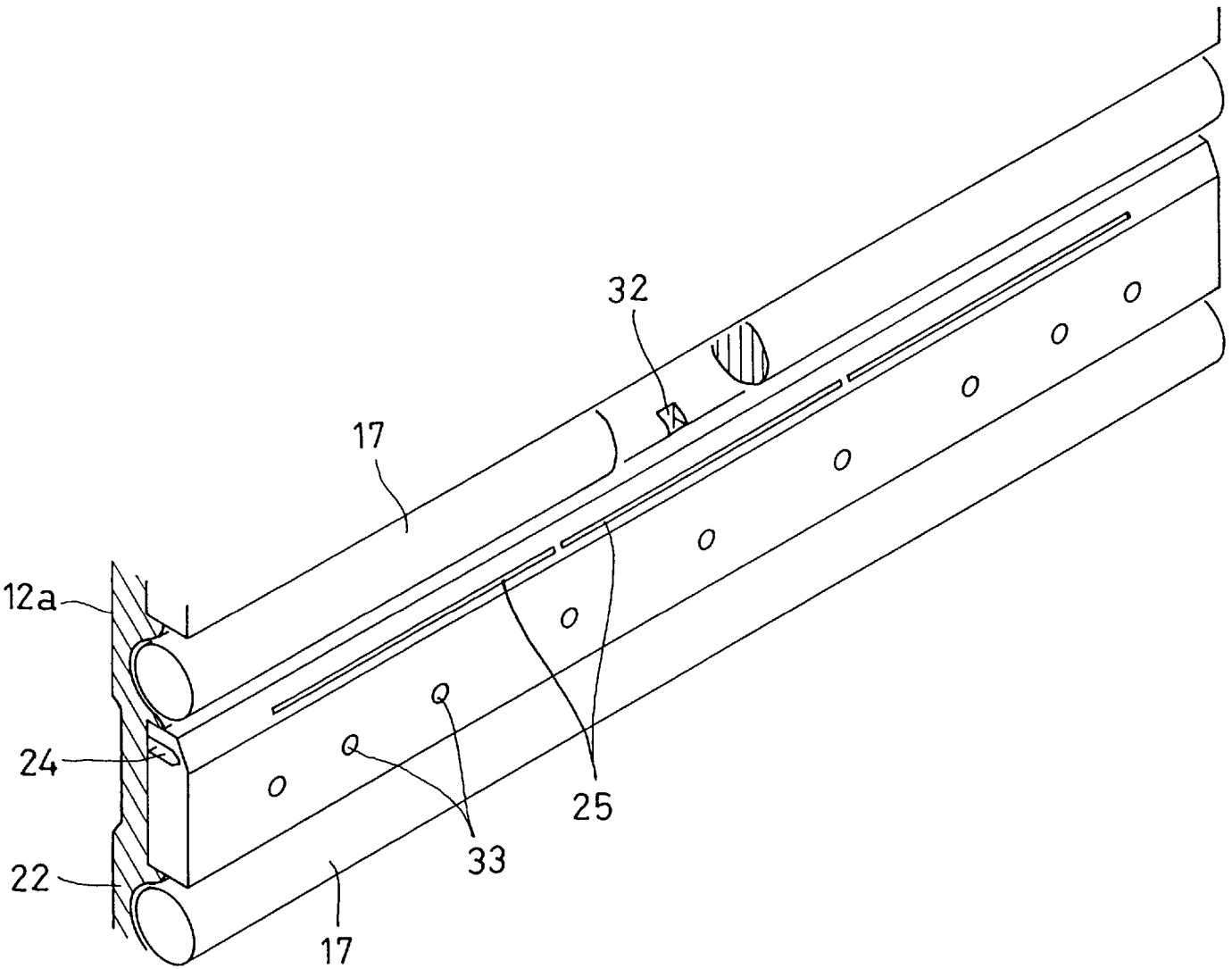
FIG. 4 is a partial exploded perspective view of a rack plate thereof.

The feed rollers 16 and the pressure rollers 17 are rotated in the directions of arrows shown in FIG. 3 so that photosensitive material A inserted into the downward feed path 14 is fed downward by the rollers 16 and 17. At the bottom of the path 14, material A is turned 180° by a turn unit 18. Material A is thus fed into the upward feed path 15 and fed upward by the rollers 16 and 17.

The turn unit 18 comprises a turn roller 19, and a turn belt 20 pressed against the bottom of the turn roller 19. The turn roller 19 is turned in the direction of the arrow in FIG. 2, so that the turn belt 20 is moved in the direction of the arrow of FIG. 2.

Referring to FIG. 3, the pressure rollers 17 are received in recesses 21 formed in the inner opposed surfaces of the rack plates 12*a* and 12*b*.

The rack plates 12*a*, 12*b* each comprise a main plate 22 in which is formed the roller-receiving recesses 21, and a plurality of guide plates 23 mounted on the main plate 22 between the adjacent roller-receiving recesses 21. In the surface of each guide plate 23 to be brought into abutment with the main plate 22, a passage 24 for treating solution is provided to extend in a width direction of the rack plates 12*a*, 12*b*. A slit-shaped nozzle 25 communicates with each passage 24 and opens at the inner surface of the respective guide plate 23. Thus, treating solution fed into the passages 24 is blown into the downward feed path 14 and the upward feed path 15 through the nozzles 25.

As shown in FIG. 1, the passages 24 communicate with treating solution supply passages 26 formed in the rack body 11 at both sides thereof. The treating solution supply passages 26 communicate with supply ports 27 provided in the bottom of the treating solution tank 1 on both sides when the rack body 11 is set in the tank 1. The supply ports 27 communicate with a sub-tank 28 communicating with the top of the tank 1 through a circulation passage 29. A pump 30 is provided in the circulation passage 29.

By activating the pump 30, treating solution in the sub-tank 28 flows through the supply ports 27 and the treating solution supply passages 26 into the passages 24 and blown into the feed paths 24 through the nozzles 25.

Figure 5:
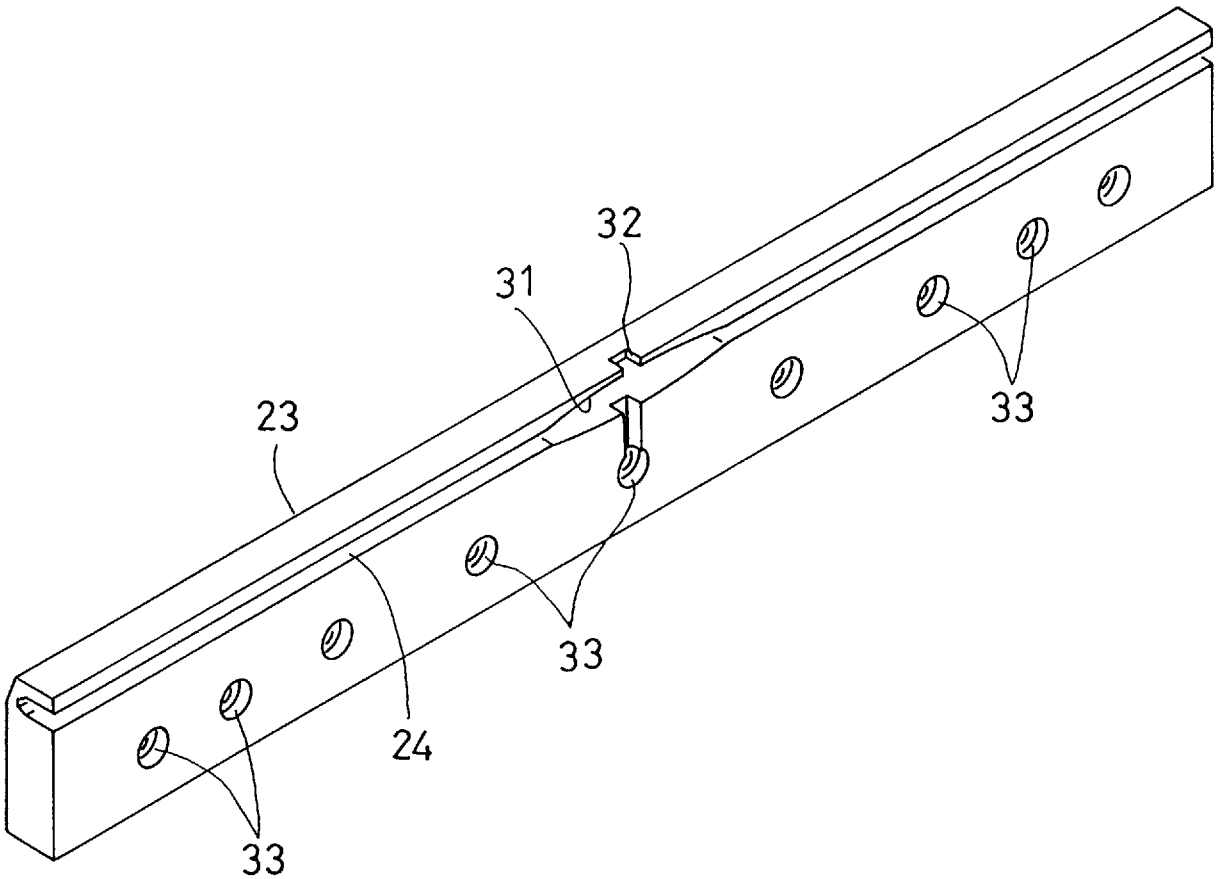
FIG. 5 is a perspective view of a guide plate thereof.

As shown in FIGS. 3 and 5, each passage 24 has an air reservoir 31. An air vent passage 32 communicates with each air reservoir 31. The air vent passage 32 formed in the left rack plate 12*a* (in FIG. 3) communicate with the roller-receiving recesses 21, while the air vent passages 32 formed in the right rack plate 12*b* communicate with treating solution return holes 33 provided over the passages 32.

Similar treating solution return holes 33 are also formed in the left rack plate 12*a*. These holes 33 extend through the respective rack plates 12*a*, 12*b* from their front to rear surface so that treating solution in the downward feed path 14 and the upward feed path 15 can circulate in the tank 1 through the holes 33.

Each air reservoir 31 has its top surface inclined toward the air vent passage 32 so that air coming into the air reservoirs 31 can smoothly flow into the air vent passages 32. The number and position of air reservoirs 31 are not limited. If a single air reservoir 31 is formed in each passage 24, such a reservoir should be formed in the longitudinal center of the passage 24. This is because treating solution is fed into the passage 24 from both ends thereof.

When the rack 10 of this invention is immersed in treating solution in the tank 1, any air in the rack body 11 is urged upward along the downward feed path 14 or upward feed path 15 by treating solution flowing into the rack body 11, and expelled from the rack body 11.

Most air in the passages 24 is also expelled therefrom by treating solution coming into the passages 24. But a small amount of air may remain in the passages 24.

But by activating the pump 30, treating solution is fed through the supply passages 26 into the passages 24 from both ends toward the center thereof. Thus, any air remaining in the passages 24 is urged into the air reservoir 31 and then expelled through air vent passages 32.

Since no air remains in the passages 24, nothing will disturb the flow of treating solution discharged from the nozzles 25 or deteriorate the treating solution.

Air flowing into the air vent passages 32 formed in the left (in FIG. 3) rack plate 12*a* flows into the downward feed path 14, flows up the path 14 and is expelled from the body 11 from its top, or flows into the tank 1 together with treating solution flowing through the treating solution return holes 33.

Air flowing into the air passages 32 formed in the right rack plate 12*b* flows into the tank 1 through the treating solution return holes 33.

Treating solution that has collided with photosensitive material A flows in the feed direction of photosensitive material A as shown in FIG. 3. Simultaneously, treating solution in the tank 1 flows into the sub-tank 28, while treating solution between the tank 1 and the rack plates 12*a*, 12*b* flows toward the sub-tank 28, so that the pressure in the treating solution return holes 31 drops.

Thus, treating solution flowing in the feed direction of photosensitive material A in the feed paths 14, 15 flows through the treating solution return holes 31 into between the space between the tank 1 and the rack 10. Solution in the tank 1 flows into the sub-tank 28. Treating solution can thus be circulated very smoothly in the rack body, so that photosensitive material can be developed uniformly with stable quality.

As described above, according to this invention, an air reservoir is formed in the center of each treating solution passage through which treating solution is fed under pressure from both ends thereof. An air vent passage is connected to the top of each air reservoir. Even if there exists air in the treating solution passages when the rack is placed in the treating solution tank, such air is caused to flow into the air reservoirs by treating solution flowing into the treating solution passages and is expelled through the air vent passages.

Thus, no air will remain in the treating solution passages. This prevents disturbance of the flow of treating solution discharged from the slits, so that film can be developed uniformly and developed film with stable quality can be obtained.

Also, treating solution is less likely to deteriorate.

What is claimed is:

1. A rack for feeding photosensitive material comprising a rack body, a pair of rack plates provided at both sides of said rack body, said rack body being formed with a pair of feed paths extending vertically along opposed inner surfaces of said rack plates and having a slit-shaped section, and a turn unit provided at the bottom end of said rack body for guiding photosensitive material fed through one of said feed paths into the other of said feed paths by changing the feed direction of the photosensitive material, each of said rack plates being formed with treating solution passages extending in the width direction of said each rack plate, and nozzles for blowing treating solution fed under pressure into said treating solution passages from outer ends thereof, each of said treating solution passages being provided with an air reservoir having its top connected to an air vent passage.

2. A rack for feeding photosensitive material as claimed in claim 1, wherein each of said rack plates is formed with a plurality of treating solution return passages extending through said each rack plate from its inner surface to outer surface.

* * * * *